US008499972B1

(12) United States Patent
Landry

(10) Patent No.: US 8,499,972 B1
(45) Date of Patent: Aug. 6, 2013

(54) CLAMPING OF BULK STORAGE BAG DISCHARGE SPOUT

(75) Inventor: Marc Steven Landry, Vernon, NJ (US)

(73) Assignee: Acrison, Inc., Moonachie, NJ (US)

( * ) Notice: Subject to any disclaimer, the term of this patent is extended or adjusted under 35 U.S.C. 154(b) by 136 days.

(21) Appl. No.: 13/166,686

(22) Filed: Jun. 22, 2011

(51) Int. Cl.
*B67D 7/06* (2010.01)
*B65D 35/56* (2006.01)

(52) U.S. Cl.
USPC ..... 222/105; 222/181.2; 414/403; 141/114; 141/383

(58) Field of Classification Search
USPC ..... 222/105, 181.1, 181.2, 185.1, 460, 222/461; 141/114, 313–317, 368, 383–386; 414/403, 415, 291
See application file for complete search history.

(56) References Cited

U.S. PATENT DOCUMENTS

| | | | | |
|---|---|---|---|---|
| 1,554,550 | A * | 9/1925 | Berger | 248/101 |
| 4,519,426 | A * | 5/1985 | Hardy, Jr. | 141/5 |
| 4,790,708 | A * | 12/1988 | von Bennigsen-Mackiewicz et al. | 414/403 |
| 4,966,311 | A * | 10/1990 | Taylor | 222/105 |
| 5,944,070 | A | 8/1999 | Schmidt et al. | |
| 6,340,100 | B1 | 1/2002 | Gill et al. | |
| 7,159,744 | B2 * | 1/2007 | Sterner et al. | 222/202 |
| 7,223,058 | B2 * | 5/2007 | Nyhof | 414/415 |
| 2001/0027822 | A1 | 10/2001 | Bertolo | |
| 2005/0194406 | A1 * | 9/2005 | Kosich | 222/181.1 |

FOREIGN PATENT DOCUMENTS

JP 2009-208824 9/2009

* cited by examiner

*Primary Examiner* — Kevin P Shaver
*Assistant Examiner* — Nicholas J Weiss
(74) *Attorney, Agent, or Firm* — Fish & Richardson P.C.

(57) ABSTRACT

A clamping system secures a discharge spout of a bulk storage bag to an outer surface of a process interface connection. The clamping system includes a first clamping arm and a second clamping arm. Each clamping arm has a fixed end and a free end arranged such that the free end can pivot about the fixed end between a clamping position and an open position. Each clamping arm has an inner clamping surface configured to clamp a portion of the discharge spout against a portion of the outer surface of the process interface connection when the clamping arm is in the clamping position. The inner clamping surfaces are arranged such that when the first and second clamping arms are in the clamping position, the inner clamping surfaces cooperate to clamp the discharge spout against substantially the entire outer surface of the process interface connection.

21 Claims, 9 Drawing Sheets

CLAMPING OF BULK STORAGE BAG DISCHARGE SPOUT

FIELD OF THE INVENTION

This disclosure relates to bulk storage bags and, more particularly, relates to clamping of a bulk storage bag discharge spout to a process interface connection, for example.

BACKGROUND

In the dry solids industry, bulk storage bags have become more prevalent in transporting and storing many of the vast number of materials available today. This change has occurred, in part, due to the reduced cost associated with using bulk storage bags verses other traditional methods. They are generally cost effective, easily handled, transported and stored. Moreover, the integration of bulk bags into traditional feeding systems has spawned many new and innovative designs.

Since the use of Bulk Bags has entered the processing industry, there have been many developments associated with handling and discharging material from these containers. For example, vibration and various types of mechanical agitation devices are commonly utilized to effectively promote the discharge of materials that have taken a set (e.g., compacted or hardened) within a bulk storage bag during transit or storage.

SUMMARY OF THE INVENTION

In one aspect, a clamping system is disclosed that secures the discharge spout of a bulk storage bag to an outer surface of a process interface connection. The clamping system includes a first clamping arm and a second clamping arm. Each clamping arm has a fixed end and a free end arranged such that the free end can pivot (e.g., in a clamshell-style manner) about the fixed end between a clamping position and an open position. Each clamping arm has an inner clamping surface configured to clamp a portion of the discharge spout against a portion of the outer surface of the process interface connection when the clamping arm is in the clamping position. The inner clamping surfaces are arranged such that when the first and second clamping arms are in the clamping position, the inner clamping surfaces cooperate to clamp the discharge spout against substantially the entire outer surface of the process interface connection.

In a typical implementation, there is a bead or bar near an upper edge of the process interface connection that grips the discharge spout when the clamping arms are in the clamping position. This arrangement can help prevent the discharge spout from slipping when, as discussed below, the mechanism (including, for example, the process interface connection and clamping arms) is lowered and tension is applied to remove pleats in the discharge spout. The bead or bar may have a cross-section that is rectangular, square or some other shape that facilitates gripping (or biting).

In a typical implementation, the first and second clamping arms are movable between the clamping position and the open position within a common plane. The common plane can be, for example, substantially perpendicular to an axis of the process interface connection.

According to some embodiments, each inner clamping surface has a substantially resilient material. Moreover, each inner clamping surface and corresponding mating section on the outer surface of the process interface connection can be contoured so as to produce a serpentine path, through which a bulk storage bag's discharge spout can pass. This can include, for example, both being contoured in a non-linear and complementary manner.

In some embodiments, an outer conduit surrounds at least part of the process interface connection. In these embodiments, the process interface connection and the outer conduit define a substantially annular space therebetween. In such implementations, the clamping arms typically include outwardly-extended portions that are adapted to cooperatively cover at least part (or all) of the substantially annular space when the clamping arms are in the clamping positions. Moreover, each outwardly-extended portion has a bend at its outer circumferential edge. The bends extend in a direction parallel to the axis of the process interface connection. The bends are configured such that, together, they extend around substantially an entire perimeter of the process interface connection.

In a typical implementation, there is a discharge tube extending from the outer conduit. The discharge tube is configured to allow displaced air to escape from the annular space when, for example, material is being dispensed from a bulk storage bag into the process interface connection.

The clamping system typically includes a manually-operable latching mechanism to urge and latch the first and second clamping arms into the clamping position.

The manually-operable latching mechanism typically includes a first engagement feature at the free end of the first clamping arm and a first pull-action latch clamp proximate the free end of the second clamping arm. The first pull-action latch clamp has a first gripping element adapted to grippingly engage the first engagement feature; and a first lever coupled to the first gripping element and arranged such that manipulating the lever when the first gripping element is grippingly engaged to the first gripping element urges at least one of the free ends toward the other free end.

The manually-operable latching mechanism also typically has a second engagement feature at the free end of the second clamping arm. The second engagement feature is configured to be grippingly engaged by a second pull-action latch clamp.

According to another aspect, a system includes a process interface connection (e.g., a substantially cylindrical tube) configured to receive dry solids flowing at least partially under the influence of gravity from a bulk storage bag suspended above the process interface connection. A system can secure a discharge spout of the suspended bulk storage bag to an outer surface of the process interface connection. The system includes a first clamping arm and a second clamping arm.

Each clamping arm has a fixed end and a free end arranged such that the free end can pivot about the fixed end between a clamping position and a non-clamping position. Each clamping arm also has an inner clamping surface configured to clamp a portion of the discharge spout against a portion of the outer surface of the process interface connection when the clamping arm is in the clamping position. The inner clamping surfaces are arranged such that when the first and second clamping arms are in their respective clamping positions, the inner clamping surfaces cooperate to clamp the discharge spout against at least substantially the entire (e.g., the entire) outer surface of the process interface connection.

The first and second clamping arms typically are movable between the clamping position and the non-clamping position within a common plane.

Each inner clamping surface is substantially resilient (e.g., includes a substantially resilient element that may be contained, for example, in a recess) and may be contoured in a non-linear manner to engage a correspondingly contoured section on the outer surface of the process interface connection.

In some implementations, an outer conduit/outer conduit section surrounds at least part of the process interface connection and defines, with the process interface connection, a substantially annular space between the outer surface of the process interface connection and the outer conduit section.

Each clamping arm typically includes an outwardly-extended portion that is adapted to cover at least part of (or all of) the substantially annular space when the clamping arm is in the clamping position. Moreover, the outwardly-extended portions cooperatively cover at least substantially all (e.g., all) of the substantially annular space when the first clamping arm and second clamping arm are in their respective clamping positions.

The system also can include a discharge tube extending from the outer conduit section and configured to allow displaced air and/or dust to escape the annular space when material is being dispensed from a bulk storage bag into the process interface connection.

According to some embodiments, the system can include a manually-operable latching mechanism to urge the first and second clamping arms into the clamping position. The manually-operable latching mechanism, in a typical implementation, includes a first engagement feature at the free end of the first clamping arm and a first pull-action latch clamp at the free end of the second clamping arm.

The first pull-action latch clamp can include a first gripping element adapted to grippingly engage the first engagement feature and a first lever coupled to the first gripping element and arranged such that manipulating the lever when the first gripping element is grippingly engaged to the first gripping element urges at least one of the free ends to move toward the other of the free ends.

The system also can include a second pull-action latch clamp coupled to an outer surface of the process interface connection or to an outer surface of a conduit surrounding at least part of the process interface connection; and a second engagement feature at the free end of the second clamping arm, wherein the second engagement feature is configured to engage the second pull-action latch clamp.

The system typically includes structural frame arranged to suspend the bulk storage bag above the process interface connection.

In certain implementations, an actuator (e.g., a pneumatic actuator) is provided to move the process interface connection toward or away from the bulk storage bag suspended above the process interface connection.

According to yet another aspect, a system includes a process interface connection, a bulk storage bag suspended above the process interface connection, the process interface connection having an opening configured to receive dry solids flowing at least partially under the influence of gravity from the bulk storage bag, a clamping assembly to secure a discharge spout of the suspended bulk storage bag to an outer surface of the process interface connection. The clamping assembly includes a first clamping arm and a second clamping arm. Each clamping arm has a fixed end and a free end arranged such that the free end can pivot about the fixed end between a clamping position and a non-clamping position. Each clamping arm has an inner clamping surface configured to clamp a portion of the discharge spout against a portion of the outer surface of the process interface connection when the clamping arm is in the clamping position. The inner clamping surfaces of the first and second clamping arms are arranged such that when the first and second clamping arms are in their respective clamping positions, the inner clamping surfaces of the first and second clamping arms cooperate to clamp the discharge spout against at least substantially the entire (e.g., the entire) outer surface of the process interface connection.

In yet another aspect, a method includes: coupling a bulk storage bag containing dry solid material to a bulk bag unloader assembly with a discharge spout of the bulk storage bag directed substantially downward toward a process interface connection; arranging the discharge spout to substantially face the process interface connection; clamping the discharge spout to the outer surface of the process interface connection with a clamping system. The clamping system includes a first clamping arm and a second clamping arm. Each clamping arm has a fixed end and a free end arranged such that the free end can pivot about the fixed end between a clamping position and a clamping position. Each clamping arm also has an inner clamping surface configured to clamp a portion of the discharge spout against a portion of the outer surface of the process interface connection when the clamping arm is in the clamping position. The inner clamping surfaces of the first and second clamping arms are arranged such that when the first and second clamping arms are in their respective clamping positions, the inner clamping surfaces of the first and second clamping arms cooperate to clamp the discharge spout against at least substantially the entire (e.g., the entire) outer surface of the process interface connection.

Particular embodiments of the subject matter described in this specification can be implemented so as to realize one or more of the following advantages.

For example, many bulk storage bag manufacturers typically manufacture bags with an 18 inch long discharge spout. With conventional mechanisms for securing a discharge spout to a conduit, it can be extremely difficult, if not impossible, to secure such a short discharge spout to the conduit. This is because the space required to allow an operator access for attachment of the bag spout to a process interface connection is more than that which this standard spout length allows. Indeed, many bulk bag unloader manufacturers require a 21" or longer bag spout length as a minimum. This creates an added cost to the end user who must now pay a premium for non-standard bulk bags.

In a typical implementation of the techniques and structures disclosed herein, the clamp plate opens to the left and right of the operator, allowing for full access to the process interface connection without any additional bag length requirement. Thus, the operator is able to attach a discharge spout that has a relatively short length to the process interface connection with ease and efficiency.

Additionally, many processors are not willing to customize the bulk storage bags they use. If this is the case and a longer bag spout is not available, the use of certain conventional bag spout connection designs cannot be considered. In a typical implementation, this situation can be avoided.

Moreover, in certain implementations, the potential of having a discharge spout slip out of engagement with the process interface connection is reduced. This can be particularly significant when, for example, after being secured to the process interface connection, the process interface connection and clamping system are lowered.

Also, when the process interface connection and clamping system are lowered, any pleats that may exist in its spout are removed, which aids in product discharge through the spout. Removing pleats and folds from the spout of a Bulk Bag as it empties can also be accomplished by utilizing an Automatic Bulk Bag Tensioning Mechanism, such as available from Acrison, Inc. of Moonachie, N.J., which can be integral to the applicable bulk storage bag frame assembly.

In a typical implementation, the techniques and structures disclosed herein bring the discharge spout clamps close to the operator, thus making for a highly ergonomic design. The techniques and structures also typically result in a design that is cost effective.

Terms describing relative positions, such as "left," right," "in," "out," "front," "back," "up," "down, "top," "bottom," "over," "under," "above," "below," "horizontal," "vertical" and the like, in the description and the claims, if any, are used for descriptive purposes and not necessarily for describing permanent relative positions. It is to be understood that the terms so used are interchangeable under appropriate circumstances such that embodiments of the invention described herein are, for example, capable of operation in other orientations than those illustrated or otherwise described herein.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numerals refer to like element.

DETAILED DESCRIPTION OF THE DRAWINGS

Figure 1:
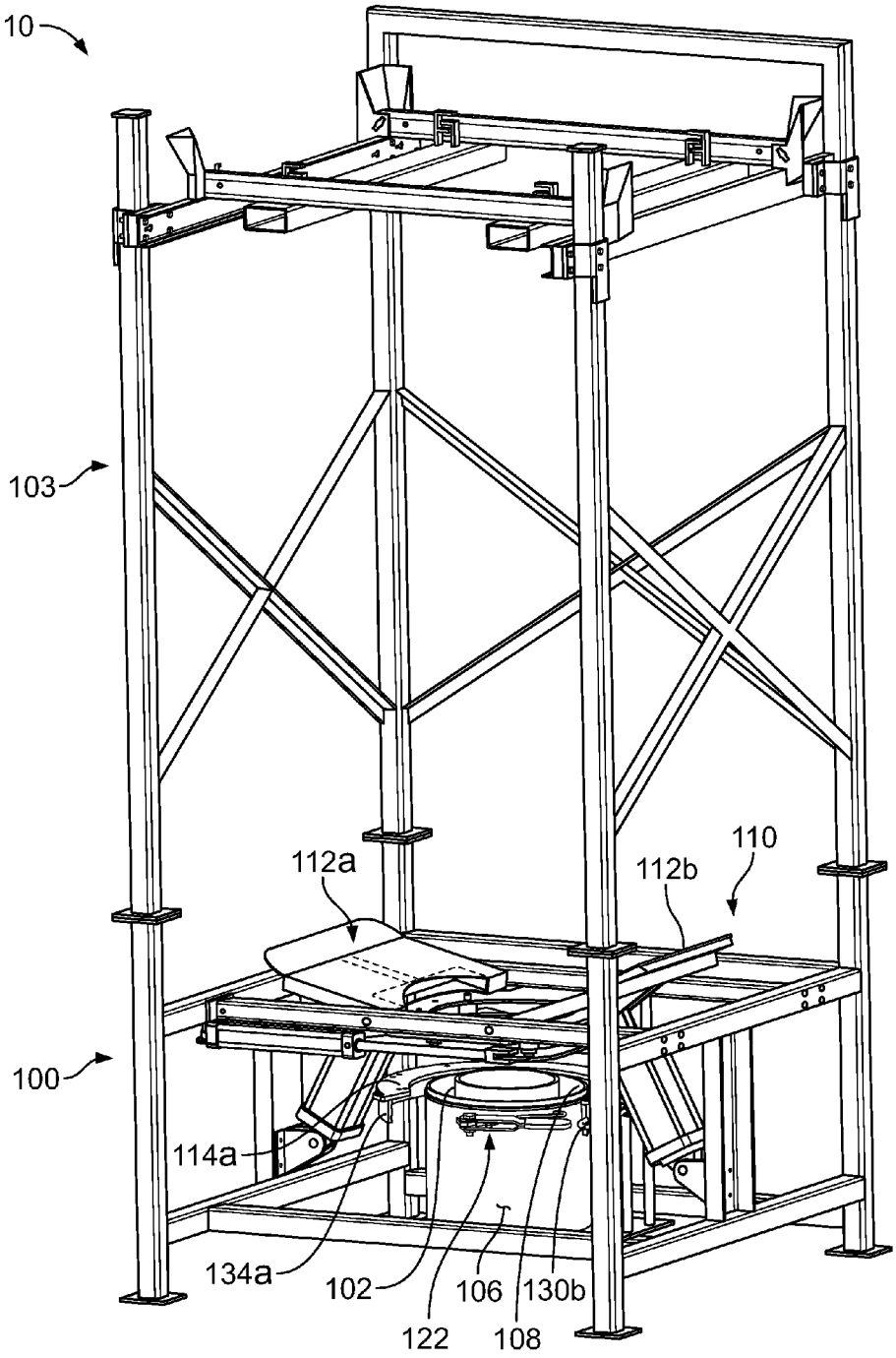
FIG. 1 is a perspective view of an implementation of a system that includes a bulk storage bag unloader assembly and a structural frame element for supporting a bulk storage bag.
Figure 2:
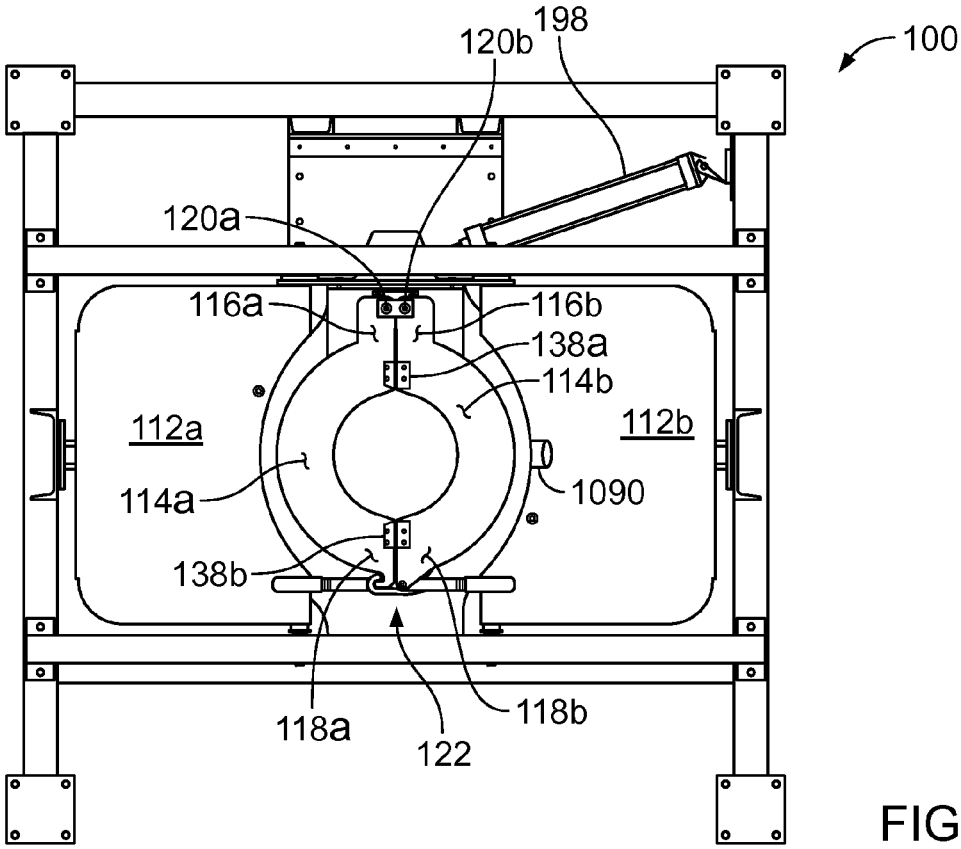
FIG. 2 is a plan view of the bulk storage bag unloader assembly of FIG. 1.
Figure 3:
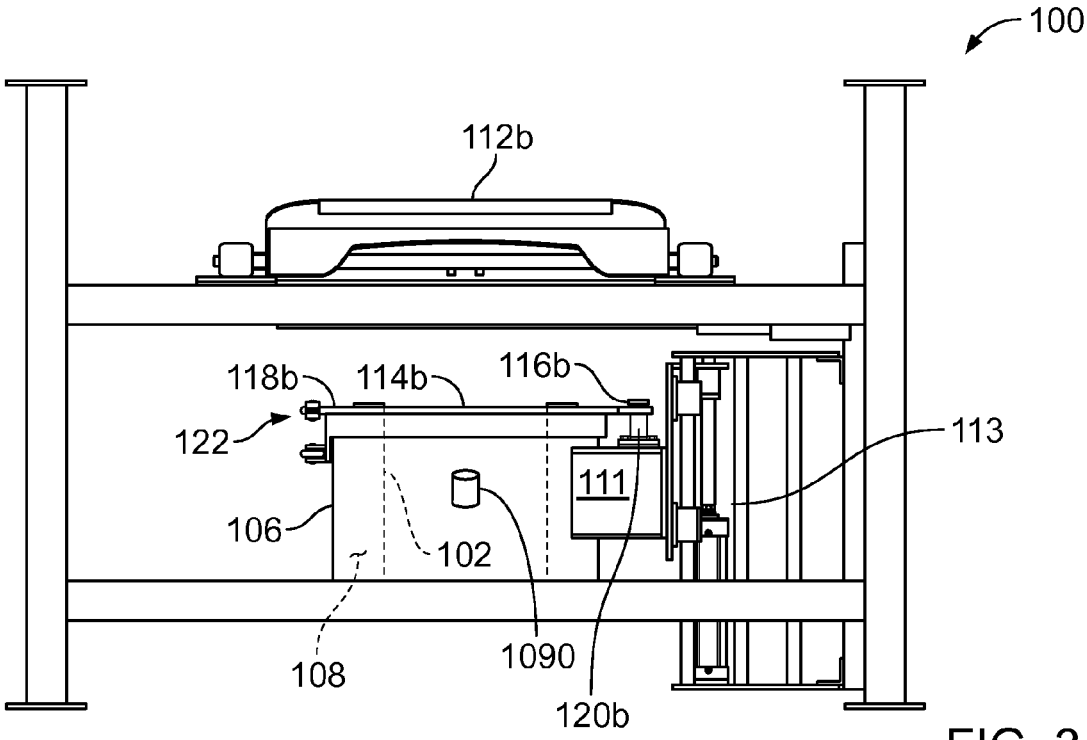
FIG. 3 is a side view of the bulk storage bag unloader assembly of FIG. 1.
Figure 4:
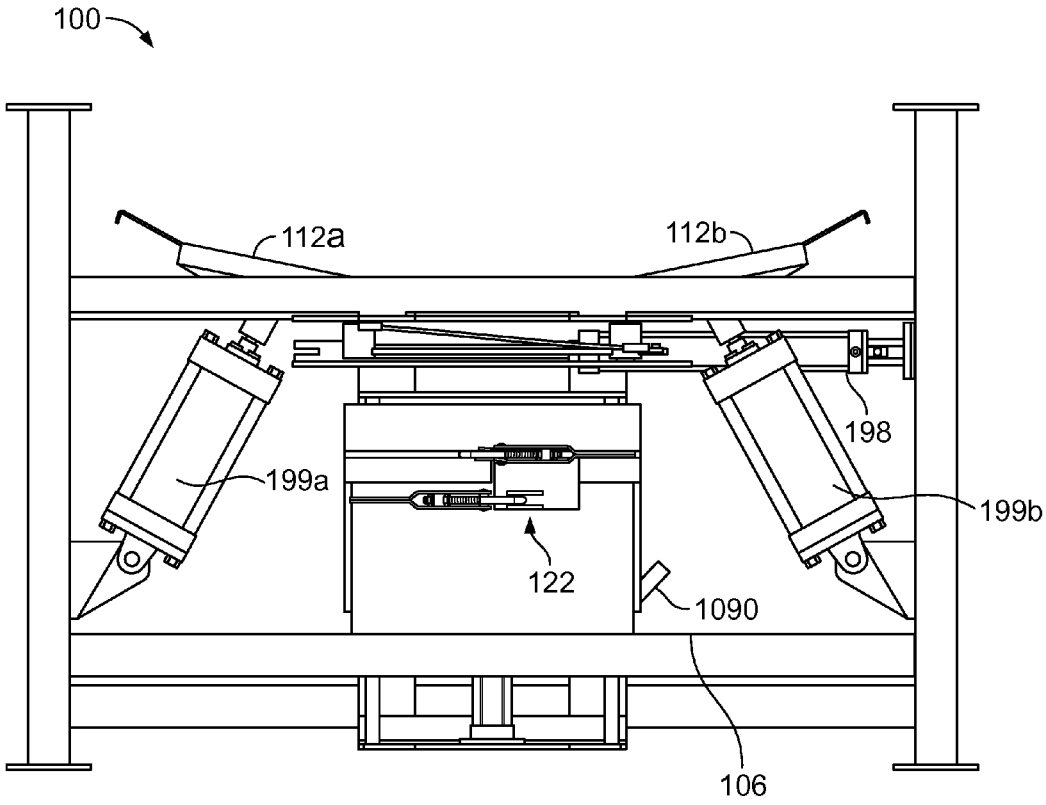
FIG. 4 is a front view of the bulk storage bag unloader assembly of FIG. 1.
Figure 6:
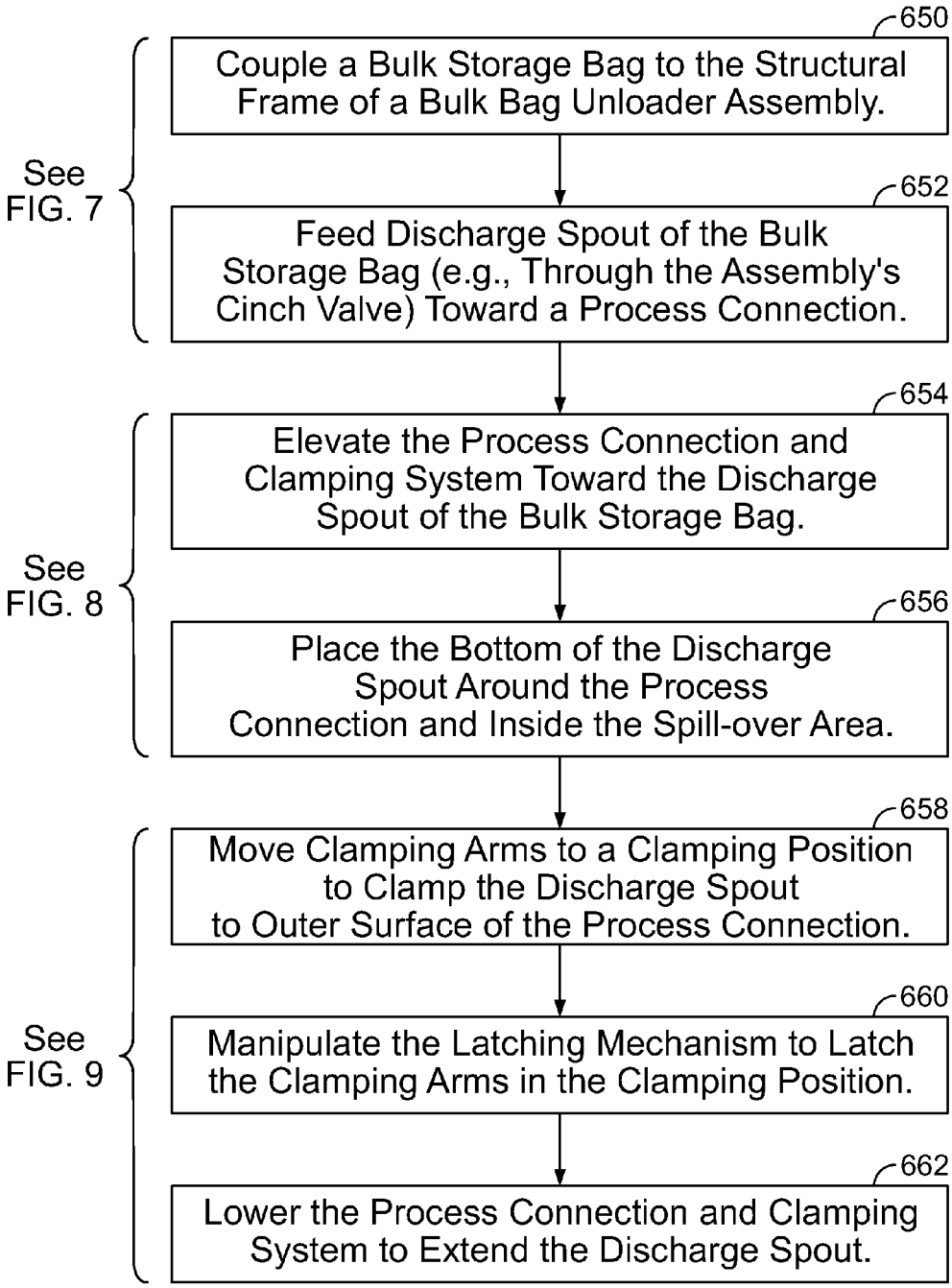
FIG. 6 is a flowchart of a method of using a system that includes a bulk storage bag unloader assembly and a structural frame element for supporting a bulk storage bag.
Figure 7:
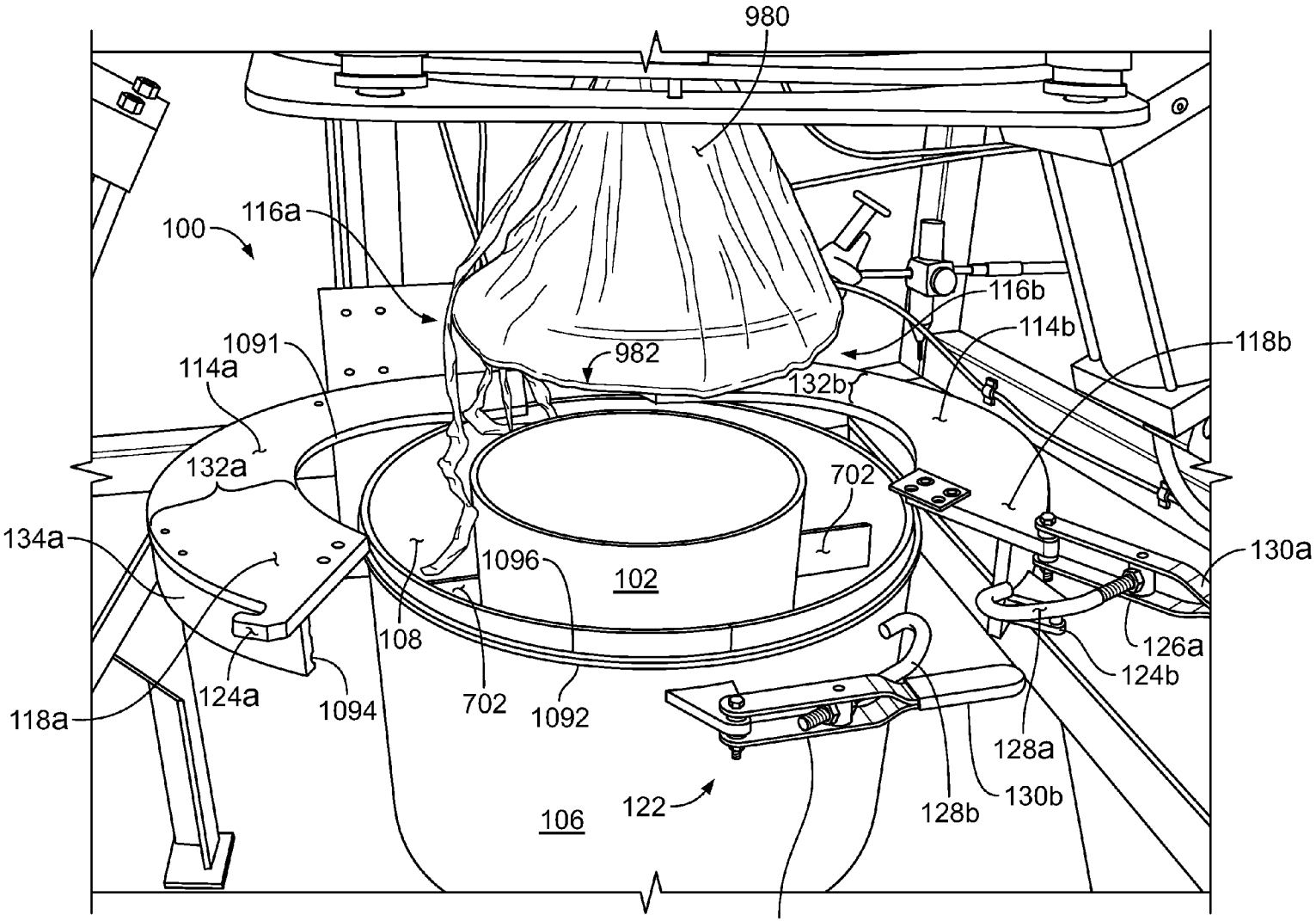
FIG. 7 is a partial perspective view of an unloader assembly with a bulk storage bag.
Figure 8:
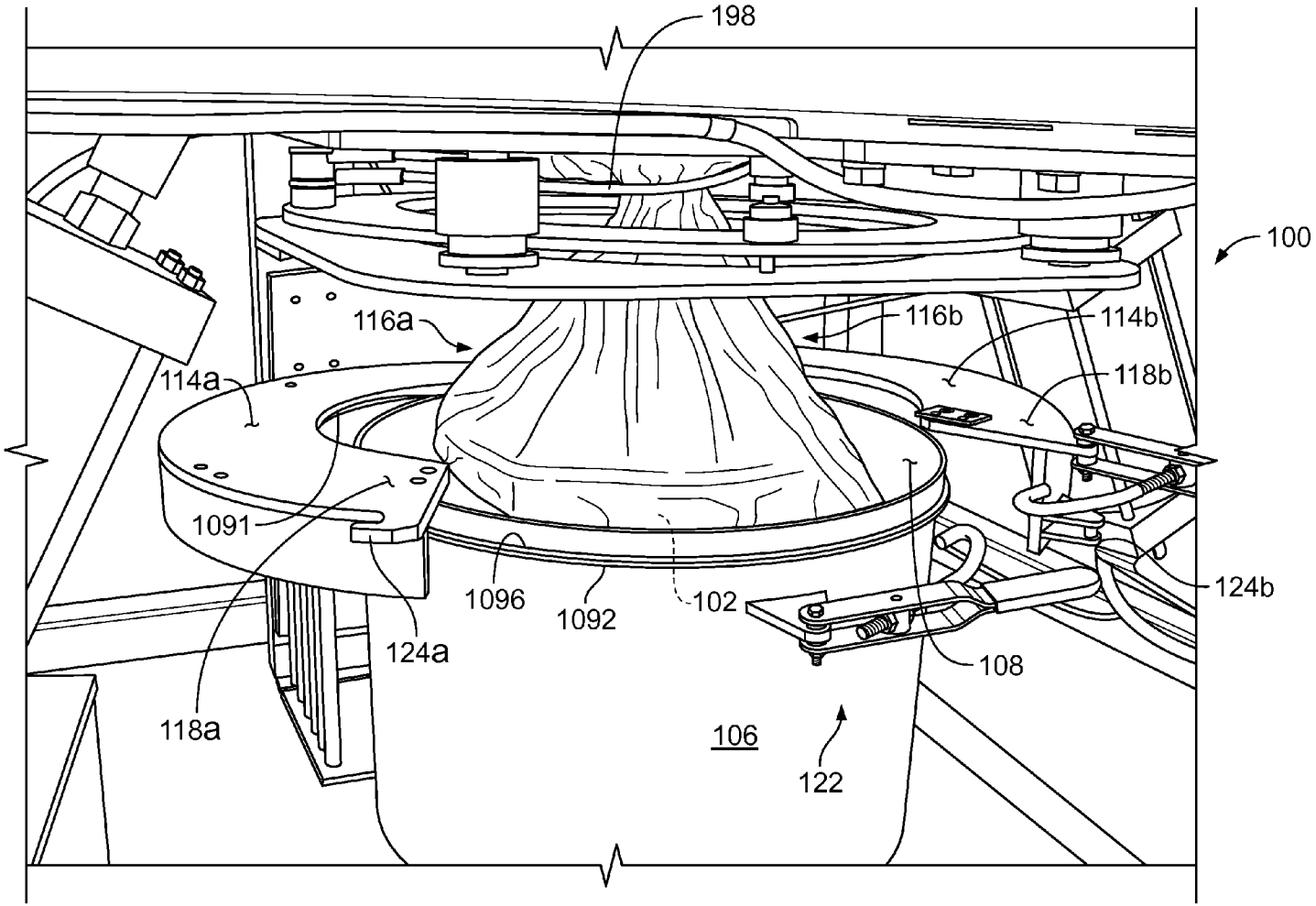
FIG. 8 is a partial perspective view of the unloader assembly in FIG. 7 with the bulk storage bag's discharge spout placed around a process interface connection.

FIG. 1 shows a typical system 10 that includes a bulk bag unloader assembly 100 with a structural frame element 103 for supporting a bulk storage bag (not shown) above the unloader assembly 100. FIGS. 2 to 4 show the unloader assembly 100 of FIG. 1. FIG. 5 shows a pair of clamping arms. FIGS. 6 to 8 show the system 10 being connected to a bulk storage bag.

The unloader assembly 100 includes a process interface connection 102, which in the illustrated implementation is a substantially cylindrical conduit with an upwardly-facing open end, through which material from the bulk storage bag can be introduced into a process (e.g., a process involving weigh feeding or volumetric feeding of the material from the bulk storage bag). In a typical implementation, the bottom end of the process interface connection 102 is connected to or arranged to deliver material to the process. For example, the bottom end of the process interface connection 102 may be physically coupled to a conduit or physically arranged so as to empty material into adjacent downstream equipment.

The structural frame element 103 is adapted to physically support a bulk storage bag (not shown in FIG. 1) above the unloader assembly 100 so that the bulk storage bag's discharge spout can be coupled to the process interface connection 102. When the discharge spout is so coupled and uncinched, the contents of the bag are able to flow, at least partially under the influence of gravity, out of the discharge spout and into the process interface connection 102.

The unloader assembly 100 includes a clamping system 104 that enables an operator to securely couple (or "clamp") the discharge spout of the bulk storage bag to the outer surface of the upwardly-facing, open end of the process interface connection 102. In a typical implementation, this clamping process can be performed in a safe, easy and reliable manner.

The illustrated clamping system 104 includes an outer conduit section 106, which is optional, surrounding at least part of the process interface connection 102. Typically, the upper surface of the process interface connection 102 extends slightly beyond (e.g., between about 1 and 10 inches) the upper surface of the outer conduit section 106. The portion of the process interface connection 102 that extends slightly beyond the upper surface of the outer conduit section 106 typically gives the user a clear view of the process connection point (i.e., the point on the process interface connection 102 where the discharge spout connects).

In a typical implementation, the outer conduit section 106 is rigidly secured to the process interface connection 102, for example, by a rigid connecting element (see 702 in FIG. 7) that extends between an inner surface of the outer conduit section 106 and an outer surface of the process interface connection 102.

Figures 10, 10A, 10B:
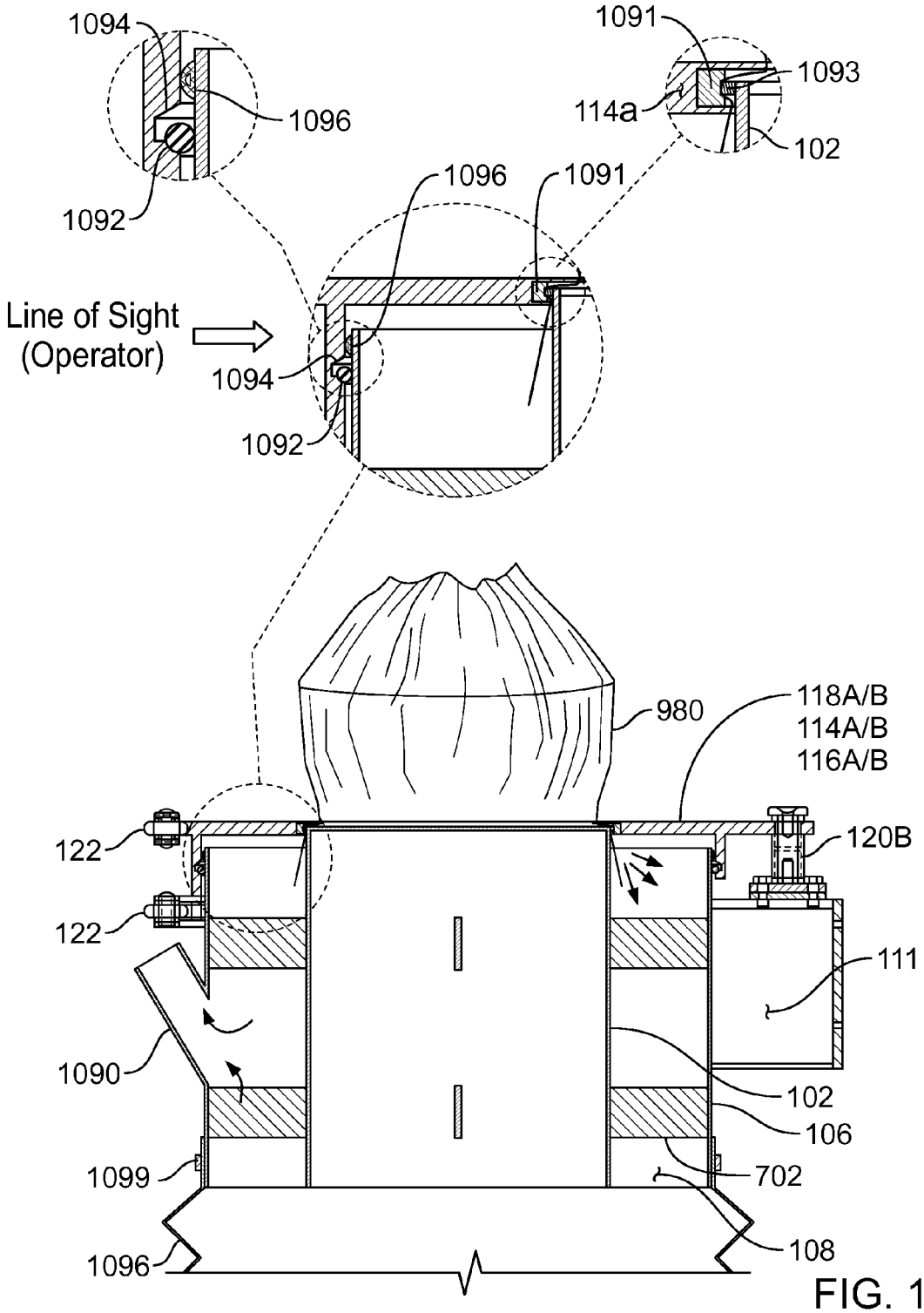
FIG. 10 is a partial cross-sectional view showing the bulk storage bag unloader assembly of FIG. 1 with a bulk storage bag coupled to the assembly.

When connected to downstream process equipment, the process interface connection 102 conveys material flowing out of the bulk storage bag to the downstream process equipment. However, the actual connection to the downstream process equipment is made to the outer conduit 106. In a particular implementation, an example of which is shown in FIG. 10, this connection is made via a corrugated bellows 1096. In the illustrated implementation, the corrugated bellows 1096 is designed to expand or collapse so as to allow the clamping assembly 104 to move up or down, respectively, relative to the downstream process equipment while maintaining a substantially dust tight and/or air tight connection to the downstream process equipment.

Together, the process interface connection 102 and the outer conduit section 106 define a substantially annular space 108 therebetween.

In some implementations, the annular space 108 can capture any material dispensed from the bulk storage bag that does not end up entering the process interface connection 102, thereby preventing a mess from occurring around the unloader assembly 100. It may be possible for a small amount of material to enter the annular space 108 when, for example, a user is removing a not-yet-empty bag from the system 10, which may be done for a variety of reasons.

In some implementations, the annular space 108 can provide a path for any material that may have been caught in the pleats of a bulk storage bag's discharge spout to fall down toward the downstream process equipment.

Additionally, in some implementations, the annular space 108 provides a path for displaced air and/or dust to escape (see, e.g., arrows in FIG. 10) when material is being dispensed from a bulk storage bag into the process interface connection 102. In some implementations (see, e.g., FIG. 10), there is a discharge tube 1090 formed in the outer conduit 106. The discharge tube 1090 allows the displaced air to escape the annular space 108. In some implementations, a dust collector (not shown) is attached to the open, discharge end of the discharge tube 1090.

The outer conduit section 106 is coupled to a support element 111 and an actuator 113 that can cause the support element 111 (and, therefore, both the outer conduit section 106 and the process interface connection 102) to move up or down (i.e., either toward or away from the bulk storage bag's discharge spout. In the illustrated implementation, the actuator 113 is pneumatically powered. However, in various implementations, the actuator can be operated using other sources of energy, such as electric, hydraulic, pneumatic, or the like.

Figure 5B:
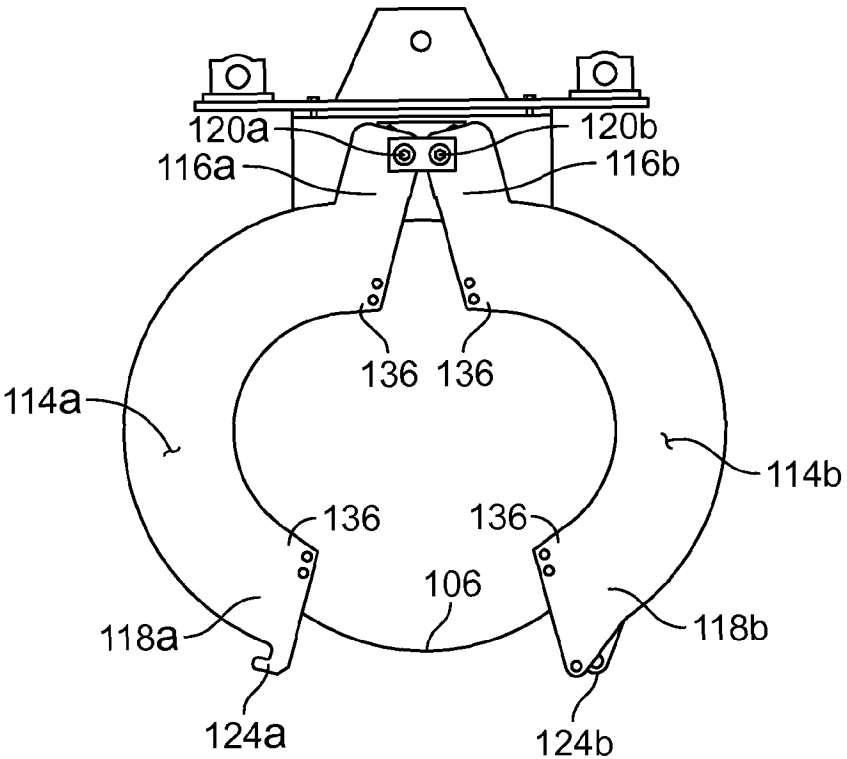
FIG. 5B is a plan view showing a bulk storage bag unloader assembly's clamping arms in a non-clamping position.

The clamping system 104 also includes a pair of clamping arms (i.e., a first clamping arm 114*a* and a second clamping arm 114*b*) that are respectively mounted to pivot pins (not shown in FIG. 1, but see 120*a*, 120*b* in FIG. 2) that allow the clamping arms 114*a*, 114*b* to pivot in a clamshell-style manner between a clamping position (see, e.g., FIG. 5A) and a non-clamping position (see, e.g., FIG. 5B). The pivot pins 120*a*, 120*b* are mounted to the support element 111.

Each clamping arm 114*a*, 114*b* has a fixed end 116*a*, 116*b*, which is fixed to one of the pivot pins 120*a*, 120*b*, and a free end 118*a*, 118*b*, which is able to swing about the corresponding fixed end. In the illustrated implementation, the free ends 118*a*, 118*b* move within a substantially horizontal plane. In a typical implementation, the clamping arms 114*a*, 114*b* are considered to be in a clamping position when their free ends 118*a*, 118*b* are positioned close to one another. In some instances, the free ends 118*a*, 118*b* are in contact with one another in the clamping position.

Figure 5A:
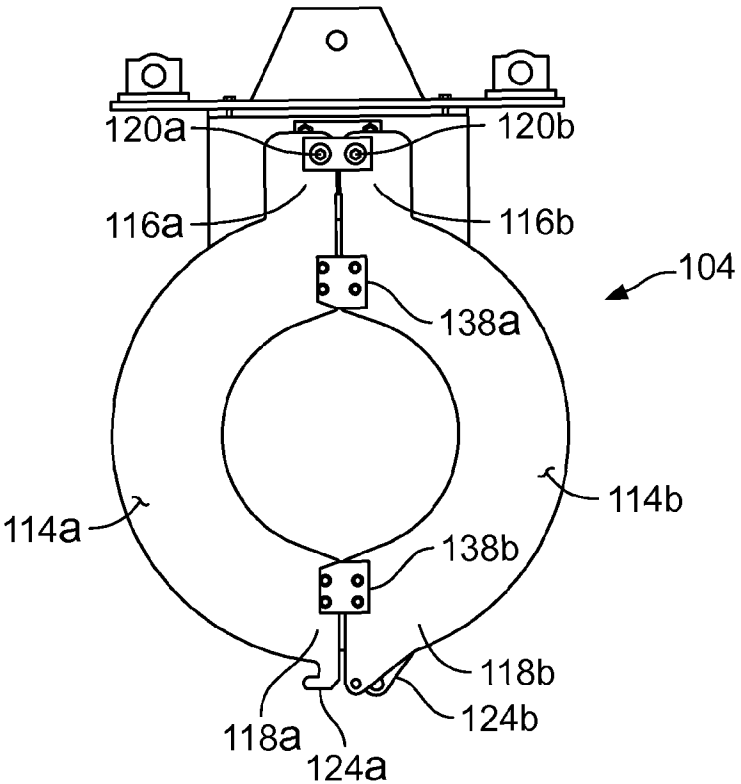
FIG. 5A is a plan view showing a bulk storage bag unloader assembly's clamping arms in a clamping position.

Each clamping arm 114*a*, 114*b* has an inner surface that is contoured to match part of the contour of the outer surface of the process interface connection 102. Accordingly, when the clamping arms 114*a* 114*b* are in the clamping position (i.e., as shown in FIG. 5A), their inner surfaces can press and seal a discharge spout of a bulk storage bag against the corresponding portions of the outer surface of process interface connection 102. In a typical implementation, the clamping arms 114*a*, 114*b* cooperatively press and seal the discharge spout against the entire (or substantially the entire) outer surface of the process interface connection 102.

In some implementations, the inner surface of each clamping arm 114*a*, 114*b* and/or corresponding (mating) portions of the outer surface of the process interface connection 102 include a substantially resilient material (e.g., rubber or the like). This allows a small amount of elastic deformation to occur when pressing and sealing the discharge spout of the bulk storage bag and enables the inner surface or corresponding portion of the outer surface to return at least substantially to its previous size without permanent deformation. The elastic deformation can, in some instances, facilitate better sealing.

In some implementations, the inner surfaces of the clamping arms 114*a*, 114*b* and the corresponding (mating) portions of the outer surface of the process interface connection 102 are contoured in a non-linear, but complementary manner. The contours can form any non-linear pattern including, for example, a serpentine pattern, a sinusoidal pattern, a saw tooth pattern, a triangle wave pattern, a square wave pattern, or the like. The complementary contours may also facilitate better sealing.

The clamping system 104 further includes a manually-operable latching mechanism 122 to urge the clamping arms 114*a*, 114*b* together and releasably hold clamping arms 114*a*, 114*b* in the clamping position.

The manually-operable latching mechanism 122 includes a first engagement feature 124*a* at the free end 118*a* of the first clamping arm 114*a*, and a second engagement feature 124*b* at the free end 118*b* of the second clamping arm 114*b*. In the illustrated implementation, the first engagement feature 124*a* is a hook and the second engagement feature 124*b* is a vertical tube.

The manually-operable latching mechanism 122 also a first pull-action latch clamp 126*a* at the free end 118*b* of the second clamping arm 114*b* and a second pull-action latch clamp 126*b* coupled to the outer surface of the outer conduit section 106.

The first pull-action latch clamp 126*a* has a first gripping element 128*a* (e.g., a hook) that is adapted to grippingly engage the first engagement feature 124*a* and a first lever 130*a* coupled to the first gripping element 128*a*. In a typical implementation, manipulating the first lever 130*a* when the first gripping element 128*a* is grippingly engaged to the first engagement feature 124*a* causes at least one of the free ends 118*a* or 118*b* of the clamping arms 114*a*, 114*b* to move toward the other free end.

Similarly, the second pull-action latch clamp 126*b* has a second gripping element 128*b* (e.g., a hook) that is adapted to grippingly engage the second engagement feature 124*b* and a second lever 130*b* coupled to the second gripping element 128*b*. In a typical implementation, manipulating the second lever 130*b* when the second gripping element 128*b* is grippingly engaged to the second engagement feature 124*b* causes the free end 118*a* to move toward the free end 118*b*.

Once latched, the inner surfaces of the clamping arms 114*a*, 114*b* can securely seal a discharge spout of a bulk storage bag to the process interface connection to help ensure that when material is flowing out of the bulk storage bag through the discharge spout, substantially all of the material is properly directed into the process interface connection 102.

To release the pull-action latch clamps 126*a*, 126*b*, an operator simply manipulates the levers 130*a*, 130*b* in an opposite direction from the direction that the levers are manipulated to latch.

Each clamping arm 114*a*, 114*b* is further contoured to include an outwardly-extended portion 132*a*, 132*b* that covers part of the substantially annular space 108 between the outer surface of the process interface connection 102 and the outer conduit section 106 when the clamping arm 114*a*, 114*b* is in the clamping position. In a typical implementation, the outwardly-extended portions 132*a*, 132*b* cooperatively cover the entire (or substantially the entire) substantially annular space 108 when the clamping arms 114*a*, 114*b* are in the clamping position.

The outer circumferential edge of each outwardly-extended portion 132*a*, 132*b* has a bend 134*a*, 134*b* that extends in an axial direction toward and relative to the process interface connection 102. In the illustrated implementation, the bends 134*a*, 134*b* extend from their respective outwardly-extended portions 132*a*, 132*b* in a substantially downward direction. In the illustrated embodiment, the second engagement feature 124*b* of the manually-operable latching mechanism 122 is coupled to the outer surface of bend 134*b*. When the clamping arms 114*a*, 114*b* are in the clamping position, the bends 134*a*, 134*b* substantially (or entirely) surround an upper part of the outer conduit section's outer surface.

The clamping plates 114*a*, 114*b* also have bolt holes 136 arranged to enable coupling plates 138*a*, 138*b* to be connected to the clamping arms 114*a*, 144*b*. Each clamping plate 138*a*, 138*b* can be connected to the clamping arms 114*a*, 114*b* as shown, for example, in FIGS. 5A and 5B. Once connected, the clamping plates 138*a*, 138*b* further help maintain the clamping arms 114*a*, 114*b* in the clamping position.

The unloader assembly 100 also has a cinch valve 198 that is adapted to close-off the discharge spout of a bulk bag storage bag supported on the structural frame 103. This may be desirable, for example, when process stipulations require a material change before one bulk storage bag is empty to avoid the need for a processor to discharge the entire contents of the bag before a material change can be implemented, which can be costly and time consuming. A cinch valve allows for the closure of a partially emptied bulk bag when such a product change is required. An example of the cinch valve 198 is disclosed in U.S. Patent Application Publication No. 2010/0127194, which is incorporated by reference in its entirety.

The illustrated unloader assembly 100 also has a mechanical agitator assembly 110 that is adapted to assist with unloading material from bulk bags, especially those materials that may be less than completely free-flowing, or those that have become tightly packed in a bag during transit and/or storage. The illustrated mechanical agitator assembly 110 has a pair of shaker paddles 112*a*, 112*b* arranged to contact lower portions of the bulk storage bag when the bulk storage bag is supported by the frame 106. The shaker paddles 112*a*, 112*b* are powered by respective pneumatic cylinders 199*a*, 199*b* that cause the shaker paddles 112*a*, 112*b* to shake thereby moving whatever portions of the bag the shaker paddles are in contact with. In some instances, this can encourage material to flow out of the bulk storage bag. Some methods of emptying bulk bags involve the use of vibration.

Figure 9:
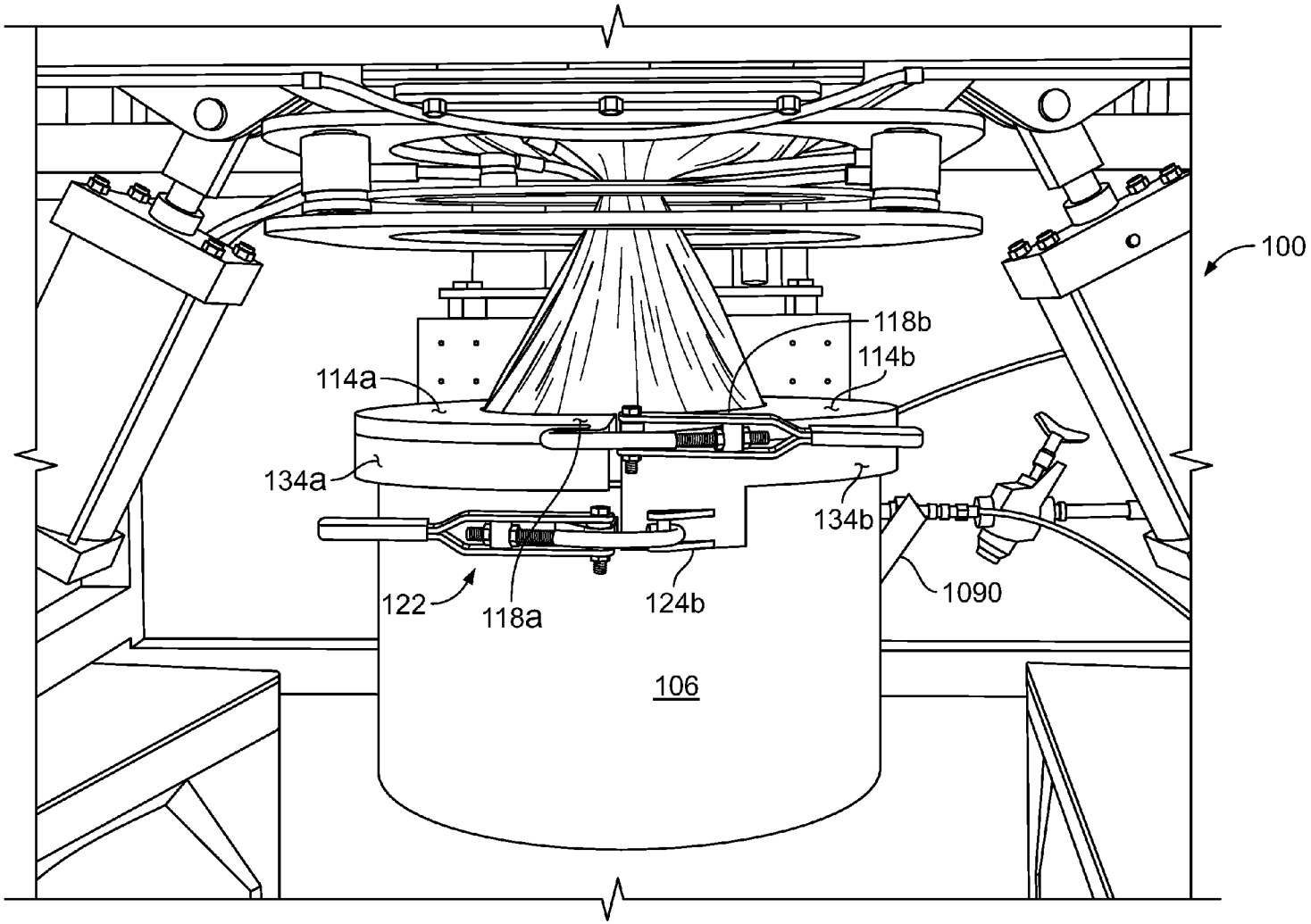
FIG. 9 is a partial perspective view of the unloader assembly in FIG. 7 with the bulk storage bag's discharge spout clamped to the process interface connection and expanded.

FIG. 6 is a flowchart of a method of using a system that includes a bulk storage bag unloader assembly and a structural frame element for supporting a bulk storage bag. FIGS. 7, 8 and 9 are referenced in the description of FIG. 6.

The illustrated method includes coupling (at 650) a bulk storage bag to the structural frame 103 of the bulk bag unloader assembly 100 and feeding (at 652) a discharge spout of the bulk storage bag through the assembly's cinch valve and toward the process interface connection 102.

An example of this is shown in FIG. 7, which shows a bulk storage bag 980 coupled to the structural frame above a bulk bag unloader assembly 100 and whose discharge spout 982 has been fed through the assembly's cinch valve (not shown) and toward the process interface connection 102. In FIG. 7, the clamping arms 114*a*, 114*b* are in a non-clamping position. More particularly, each clamping arm 114*a*, 114*b* is swung away from the clamping position so that the upper, outer perimeter of the process interface connection 102 is exposed.

Referring again to FIG. 6, the illustrated method further includes elevating (at 654) the process interface connection 102 and clamping system 104 relative to the structural frame 103 and, therefore, toward the discharge spout 982 of the bulk storage bag 980. The bottom of the discharge spout is placed (at 656) around the process interface connection 102 and inside the substantially annular space 108.

An example of this is shown in FIG. 8, which shows the process interface connection 102 and the clamping system at an elevated position relative to their position in FIG. 7. The clamping arms 114*a*, 114*b* are in the non-clamping position and the bottom of the discharge spout 982 has been placed around the process interface connection 102 inside the substantially annular space 108.

Referring again to FIG. 6, the illustrated method also includes moving (at 658) the clamping arms 114*a*, 114*b* to a clamping position to clamp the discharge spout to an outer surface of the process interface connection 102 and manipulating (at 660) the latching mechanism to latch the clamping arms in the clamping position.

The method further includes lowering (at 662) the process interface connection 102 and clamping system 104 to extend the discharge spout 982.

An example of this is shown in FIG. 9, which shows the clamping arms 114*a*, 114*b* in a clamping position and clamping the discharge spout 982 of the bulk storage bag 980 against the outer surface of the process interface connection (which is inside the outer conduit section 106). Moreover, the process interface connection and the clamping system 104 are at a lower elevation than the elevation in FIG. 8 and the discharge spout is in an extended configuration. Typically, extending the discharge spout helps ensure that the discharge spout will open fully when the bottom of the bulk storage bag is opened and flow through the discharge spout is desired.

Once the bag's discharge spout is clamped and the clamping system 104 is lowered, the clamping arms 114*a*, 114*b* prevent the bag spout from slipping by the resilient seals. Once the clamping system 104 is lowered to a predetermined tension, the bag's discharge spout supports a portion of the clamping system's weight and air pressure in the air cylinder supports the rest of the clamping system's weight. This establishes a predetermined tension that is imparted onto the clamped bag spout regardless of the spout length. When the clamping system 104 is supported in this manner, the bag's discharge spout can exert a tugging force (tension) on the clamping system 104.

In some implementations, a bead 1092 (see FIG. 10) is provided around the perimeter of the outer conduit 106. The bead 1092 may be, for example, welded to the outer surface of the outer conduit near its upper end. When the clamping arms 114*a*, 114*b* are in closed positions, recesses 1094 in the inner surfaces of the clamping arms 114*a*, 114*b* engage the bead 1092 thereby locking the clamping arms 114*a*, 114*b* and the outer conduit together.

Without the bead 1092 and recess 1094, the tugging force from the bag's discharge spout can be transmitted at least in part to the pivot pins, to which the clamping arms 114*a*, 114*b* are coupled. This force could, in some instances, potentially bend and damage the pivot pins. With the bead 1092 and the recess 1094, if there is a tugging force from the bag's discharge spout, this force is transmitted to and distributed around the outer conduit 106 due to the bead, which carries the load.

In implementations that do not include an outer conduit 106, the bead 1092 can be provided on an outer surface near the top of the process interface connection 102. Referring again to the method of FIG. 6, the binding at the bottom of the bulk storage bag (just above the discharge spout) is then released (at 662) to allow material to begin flowing through the discharge spout and into the process interface connection 102.

Typically, material continues to flow until either the bulk storage bag is empty or the process is stopped. If the material flow is to be interrupted before the bulk storage bag is empty, then the cinch valve can be manipulated to close-in and seal off the discharge spout and, thereby stop flow.

FIG. 10 is a partial cross-sectional view showing an implementation of a bulk storage bag coupled to a clamping assembly. It also includes detailed views of particular aspects of the illustrated implementation.

For example, detailed view 10A shows a bead (i.e., a perimeter support ring) 1092 provided around the perimeter of the outer conduit 106. The bead 1092 may be, for example, welded to the outer surface of the outer conduit near its upper end. When the clamping arms 114*a*, 114*b* are in closed positions, recesses 1094 in the inner surfaces of the clamping arms 114*a*, 114*b* engage the bead 1092 thereby locking the clamping arms 114*a*, 114*b* and the outer conduit together.

An outer conduit seal 1096 is provided about the bead 1092. The outer conduit seal 1096 can be a substantially resilient element and is arranged so as to provide a seal between the outer conduit 106 and downwardly-extended portions of the clamping arms 104*a*, 104*b*. The outer conduit seal helps prevent dust or gas from escaping the process. The illustrated outer conduit seal 1096 has a substantially bump-shaped cross-section. However, the outer conduit seal 1096 can have a variety of different cross-sectional shapes.

Detailed view 10B shows an example of how the discharge spout of bulk storage bag 980 follows a serpentine path through the location where clamping arm 114*a* presses against the process interface connection 102.

According to the illustrated implementation, there is a resilient seal 1091 in a recess at the inner edge of each clamping arm 114*a*, 114*b* facing the process interface connection 102. There is also a bead 1093 (e.g., a ⅛ inch square bead) extending outwardly from an outer surface of the process interface connection 102 at a position on the process interface connection 102 such that it aligns with the resilient seal 1091. In a typical implementation, the bead 1093 helps grip the bag spout to hold it securely in place. In the illustrated implementation, an inside diameter of the clamping arms immediately above and immediately below the resilient seal 1091 is smaller than the outer diameter of the process interface connection's bead 1093. This forces the bag spout to bend in extreme angles making it more difficult for the spout to be pulled out of the clamping assembly when, for example, the clamping assembly is lowered.

The illustrated implementation also includes a discharge tube 1090 that extends from an outer surface of the outer conduit and is configured to provide a ventilation channel to facilitate movement of air that has been displaced, for example from the inner process interface connection when material is being dispensed from a bulk storage bag into the process interface connection. In particular, air is allowed to flow as indicated by the arrows shown in the figure.

The illustrated implementation also shows a corrugated bellows 1096 connected (by clamp 1099) to the outer surface of the outer conduit 106 near the bottom of the outer conduit 106. In a typical embodiment, the corrugated bellows 1096 would be connected to downstream process equipment.

A number of embodiments have been described. Nevertheless, it will be understood that various modifications may be made without departing from the spirit and scope of the present disclosure.

For example, certain features disclosed herein are optional and/or can be configured differently.

The process interface connection can have different physical configurations. In various implementations it could have an oval cross-section, a rectangular cross-section or have any other shape. Depending on the shape of the process interface connection, the inner surfaces of the clamping arms may be contoured to press against some or the entire outer surface of the process interface connection. Additionally, it can be disposed at an angle, rather than facing straight up.

The agitator, the cinch valve and the actuator that moves the process interface connection and clamping system up and down are optional. Moreover, each of these structural elements can be implemented in a variety of ways other than those specifically describe herein.

Moreover, the clamping system disclosed herein includes at least two clamping arms. However, it is possible that a clamping system be provided with more than two clamping arms, as long as they are configured such that, together, they can clamp a discharge spout of a bulk storage bag against an outer surface of a process interface connection.

The relative position of components can vary as well.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that various functionalities can generally be integrated together in a single device or component or distributed across multiple devices or components.

The inner surfaces of the clamping arms 114*a*, 114*b* that press the discharge spout against the process interface connection typically are quite small (e.g., between about 0.2 and 4 inches or between about 0.5 and 2 inches in the process interface connections axial direction). However, this dimension can be larger as well.

The clamping system 104 can be provided with or without the outer conduit 106.

Also, in a typical implementation, the resilient sealing surface of the clamping arms is pressed up against a bead (e.g., a ⅛ inch square bead that is welded to the outer surface of the process interface connection 102). The bead can have a variety of shapes and configurations and can be affixed to the outer surface of the process interface connection 102 in a variety of ways.

In some implementations, the weight of the clamping system, which could be as much as 150 pounds or more, for example, is counterbalanced by air pressure introduced into a pneumatic air cylinder that supports the clamping system (e.g., on one or more vertical tracks). This air pressure typically is slightly less than the air pressure needed to lift or raise the clamping assembly. Therefore, the air pressure typically does not support the full weight of the clamping assembly and some of the weight of the clamping assembly is supported by the discharge spout coupled to the clamping assembly. In this regard, the clamping assembly typically exerts a downward force (e.g., approximately 10 pounds) on the bag's discharge spout, which helps remove pleats from the bag spout to help ensure better material flow through the spout. In various implementations, the air pressure provided can vary, such that a greater amount or a lesser amount of the clamping assembly's weight is supported by the bag spout.

In a typical implementation, an air source channel and an air bleed channel are coupled to the air cylinder that supports (and moves) the clamping system. In a typical implementation, air is delivered to the air cylinder(s) through the air source channel to raise the clamping assembly (e.g., when an operator is interested in coupling the discharge spout to the clamping assembly) and air is bled out of the air cylinder(s) through the air bleed channel to lower the clamping assembly (e.g., to remove pleats from a bag discharge spout that has been coupled to the clamping assembly). Other arrangements for raising and lowering the clamping assembly are possible.

In a typical implementation, clamp 126*b*, which is affixed to the outer conduit 106, secures clamping arm 114*a* in its final clamping position. The clamping action of 126*b* pulls the clamping plate 114*a* with its resilient seal against the bag spout and the bead on the outer surface of the process interface connection 102. Once this operation is completed, clamp 126*a* can then secure the second clamping plate 114*b*, which is affixed to the first clamping plate, into its final clamping position. Other arrangements for securing the clamping arms 114*a*, 114*b* in their locking positions are possible.

The annular space 108 between the process interface connection 102 and the outer conduit 106 is primarily used to vent off displaced air and/or dust from the process during refill. When a downstream hopper/device is low on material, a refill is required. As new material flows into the hopper/device, the air that was present is forced back up through the inlet and out the vent or to a dust collection system, for example. The outer conduit 106 can include one or more vents, which can be arranged at the same height at different points around the perimeter of the outer conduit or can be at different heights. Typically, the vent(s) extend in an upward direction (as shown in FIG. 10, for example) out of the outer conduit 106. Containing material spillage is another function of the annular space.

Additionally, in some implementations, the clamping system does not include an outer conduit 106 and, therefore, also does not include an annular space. This may be the case where, for example, system cost is a driving factor.

The height differential between the outer conduit and the inner process interface connection allows the operator to see where the spout connection is. This height difference can vary considerably. Therefore, although particular embodiments of the subject matter have been described, other embodiments are within the scope of the following claims.

What is claimed is:

1. A clamping system to secure a discharge spout of a bulk storage bag to an outer surface of a process interface connection, the clamping system comprising:

a first clamping arm and a second clamping arm, each clamping arm having a fixed end and a free end arranged such that the free end can pivot about the fixed end between a clamping position and a non-clamping position; and an outer conduit surrounding at least part of the process interface connection;

wherein each clamping arm has an inner clamping surface configured to clamp a portion of the discharge spout against a portion of the outer surface of the process interface connection when the clamping arm is in the clamping position;

wherein the inner clamping surfaces are arranged such that when the first and second clamping arms are in the clamping position, the inner clamping surfaces cooperate to clamp the discharge spout against substantially the entire outer surface of the process interface connection;

wherein the process interface connection and the outer conduit define a substantially annular space therebetween; and wherein the clamping arms include outwardly-extended portions that are adapted to cooperatively cover at least part of the substantially annular space when the clamping arms are in the clamping positions.

2. The clamping system of claim 1 wherein the first and second clamping arms are movable between the clamping position and the open position within a common plane.

3. The clamping system of claim 2 wherein the common plane is substantially perpendicular to an axis of the process interface connection.

4. The clamping system of claim 1 wherein each inner clamping surface comprises a substantially resilient material.

5. The clamping system of claim 1 wherein each inner clamping surface and corresponding mating sections on the outer surface of the process interface connection are contoured in a non-linear and complementary manner.

6. The clamping system of claim 1 wherein each outwardly-extended portion comprises a bend in a direction of the process interface connection, wherein the bends are configured such that, together, they extend around substantially an entire perimeter of the process interface connection.

7. The clamping system of claim 1 further comprising a discharge tube extending from the outer conduit and configured to allow displaced air and/or dust to escape the annular space when material is being dispensed into the process interface connection.

8. The clamping system of claim 1 further comprising:

a bead around a perimeter of the outer conduit; and a recess in an inner surface of each of the first and second clamping arms, wherein the bead and the recesses are arranged such that, when the first and second clamping arms are in the clamping positions, the recesses engage the bead thereby locking the first and second clamping arms and the outer conduit together.

9. The clamping system of claim 1 further comprising a manually-operable latching mechanism to urge and latch the first and second clamping arms into the clamping position.

10. The clamping system of claim 9 wherein the manually-operable latching mechanism comprises:

a first engagement feature at the free end of the first clamping arm;

a first pull-action latch clamp proximate the free end of the second clamping arm, the first pull-action latch clamp comprising:

a first gripping element adapted to grippingly engage the first engagement feature; and a first lever coupled to the first gripping element and arranged such that manipulating the lever when the first gripping element is grippingly engaged to the first gripping element urges at least one of the free ends toward the other free end.

11. The clamping system of claim 10 wherein the manually-operable latching mechanism comprises a second engagement feature at the free end of the second clamping arm, wherein the second engagement feature is configured to be grippingly engaged by a second pull-action latch clamp.

12. A system comprising:

a process interface connection configured to receive dry solids flowing at least partially under the influence of gravity from a bulk storage bag suspended above the process interface connection and an outer conduit section surrounding at least part of the process interface connection to define a substantially annular space between the outer surface of the process interface connection and the outer conduit section; and a clamping system to secure a discharge spout of the suspended bulk storage bag to an outer surface of the process interface connection, the clamping system comprising:

a first clamping arm and a second clamping arm, each clamping arm having a fixed end and a free end arranged such that the free end can pivot about the fixed end between a clamping position and a non-clamping position, and each clamping arm having an inner clamping surface configured to clamp a portion of the discharge spout against a portion of the outer surface of the process interface connection when the clamping arm is in the clamping position;

wherein the inner clamping surfaces are arranged such that when the first and second clamping arms are in their respective clamping positions, the inner clamping surfaces cooperate to clamp the discharge spout against substantially the entire outer surface of the process interface connection; and wherein each clamping arm includes an outwardly-extended portion, and the outwardly-extended portions cooperatively cover substantially all of the substantially annular space when the first clamping arm and second clamping arm are in their respective clamping positions.

13. The system of claim 12 wherein each inner clamping surface is substantially resilient and contoured in a non-linear manner to engage a correspondingly contoured section on the outer surface of the process interface connection.

14. The system of claim 12 wherein the first and second clamping arms are movable between the clamping position and the non-clamping position within a common plane.

15. The system of claim 12 further comprising a discharge tube extending from the outer conduit section and configured to allow displaced air and/or dust to escape the annular space when material is being dispensed from the bulk storage bag into the process interface connection.

16. The system of claim 12 further comprising a manually-operable latching mechanism to urge the first and second clamping arms into the clamping position.

17. The system of claim 16 wherein the manually-operable latching mechanism comprises:

a first engagement feature at the free end of the first clamping arm;

a first pull-action latch clamp at the free end of the second clamping arm, the first pull-action latch clamp comprising:

a first gripping element adapted to grippingly engage the first engagement feature; and a first lever coupled to the first gripping element and arranged such that manipulating the lever when the first gripping element is grippingly engaged to the first gripping element urges at least one of the free ends to move toward the other of the free ends.

18. The system of claim 17 further comprising:

a second pull-action latch clamp coupled to an outer surface of a conduit surrounding at least part of the process interface connection; and a second engagement feature at the free end of the second clamping arm, wherein the second engagement feature is configured to engage the second pull-action latch clamp.

19. The system of claim 12 further comprising a structural frame arranged to suspend the bulk storage bag above the process interface connection.

20. The system of claim 18 further comprising an actuator adapted to move the process interface connection toward or away from the bulk storage bag suspended above the process interface connection.

21. A clamping system to secure a discharge spout of a bulk storage bag to an outer surface of a process interface connection, the clamping system comprising:

a first clamping arm and a second clamping arm, each clamping arm having a fixed end and a free end arranged such that the free end can pivot about the fixed end between a clamping position and a non-clamping position; an outer conduit surrounding at least part of the process interface connection; a bead around a perimeter of the outer conduit; and a recess in an inner surface of each of the first and second clamping arms;

wherein each clamping arm has an inner clamping surface configured to clamp a portion of the discharge spout against a portion of the outer surface of the process interface connection when the clamping arm is in the clamping position;

wherein the inner clamping surfaces are arranged such that when the first and second clamping arms are in the clamping position, the inner clamping surfaces cooperate to clamp the discharge spout against substantially the entire outer surface of the process interface connection;

wherein the process interface connection and the outer conduit define a substantially annular space therebetween; and wherein the bead and the recesses are arranged such that, when the first and second clamping arms are in the clamping positions, the recesses engage the bead thereby locking the first and second clamping arms and the outer conduit together.

* * * * *